US012697534B2

(12) United States Patent
Iizuka et al.

(10) Patent No.: US 12,697,534 B2
(45) Date of Patent: Aug. 4, 2026

(54) IMPACT DETECTION DEVICE AND IMPACT DETECTION METHOD

(71) Applicant: Murata Manufacturing Co., Ltd., Kyoto (JP)

(72) Inventors: Takehiko Iizuka, Kyoto (JP); Nobuyuki Nozawa, Kyoto (JP); Tomoshige Furuhi, Kyoto (JP); Koji Kawano, Kyoto (JP); Takashi Watanabe, Kyoto (JP); Jun Makino, Kyoto (JP); Kenta Ago, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 357 days.

(21) Appl. No.: 18/446,633

(22) Filed: Aug. 9, 2023

(65) Prior Publication Data

US 2023/0381614 A1 Nov. 30, 2023

Related U.S. Application Data

(63) Continuation of application No. PCT/JP2021/042870, filed on Nov. 24, 2021.

(30) Foreign Application Priority Data

Feb. 10, 2021 (JP) ..... 2021-019524

(51) Int. Cl.
*A63B 69/36* (2006.01)
*A63B 60/46* (2015.01)
(Continued)

(52) U.S. Cl.
CPC ..... *A63B 60/46* (2015.10); *A63B 71/0619* (2013.01); *A63B 2102/32* (2015.10);
(Continued)

(58) Field of Classification Search
CPC . A63B 60/46; A63B 71/0619; A63B 2102/32; A63B 2220/20; A63B 2220/58;
(Continued)

(56) References Cited

U.S. PATENT DOCUMENTS 3,792,863 A * 2/1974 Evans ..... A63B 69/3632 340/870.18
3,806,131 A * 4/1974 Evans ..... A63B 69/3632 340/870.18

(Continued)

FOREIGN PATENT DOCUMENTS

JP 2010-187749 A 9/2010
JP 2018-175496 A 11/2018

OTHER PUBLICATIONS

International Search Report for PCT/JP2021/042870 dated Feb. 8, 2022.

*Primary Examiner* — Nini F Legesse
(74) *Attorney, Agent, or Firm* — McDonald Hopkins LLC

(57) ABSTRACT

An impact detection device includes a sensor that is attached to sports equipment including a columnar portion and a hitting portion connected to the columnar portion and is attached not at the hitting portion but at the columnar portion, and that is configured to output a sensor signal obtained by the sports equipment being swung, and a feature data extraction unit configured to detect, by using the sensor signal, from a temporal change of the sensor signal outputted by the hitting portion externally receiving pressure, timing at which the hitting portion externally receives the pressure.

14 Claims, 4 Drawing Sheets

TRANSMISSION SIDE RECEPTION SIDE

(51) Int. Cl.
*A63B 71/06* (2006.01)
*A63B 102/32* (2015.01)

(52) U.S. Cl.
CPC ..... *A63B 2220/20* (2013.01); *A63B 2220/58* (2013.01); *A63B 2220/62* (2013.01); *A63B 2220/833* (2013.01)

(58) Field of Classification Search
CPC ..... A63B 2220/62; A63B 2220/833; A63B 2220/51; A63B 2220/803; A63B 2225/74; A63B 24/0006; A63B 69/3632; A63B 2024/0068; A63B 24/0062; A63B 2225/50; A63B 71/0622; A63B 53/10
USPC ..... 473/219–226, 407, 409
See application file for complete search history.

(56) References Cited

U.S. PATENT DOCUMENTS

| | | | | |
|---|---|---|---|---|
| 5,779,555 | A * | 7/1998 | Nomura | A63B 69/3632 473/223 |
| 5,951,410 | A * | 9/1999 | Butler | A63B 60/42 473/223 |
| 6,213,888 | B1 * | 4/2001 | Kawaguchi | A63B 60/42 473/409 |
| 8,398,502 | B2 * | 3/2013 | Iwahashi | A63B 60/42 473/409 |
| 2010/0210371 | A1 * | 8/2010 | Sato | A63B 60/42 473/223 |
| 2017/0340936 | A1 * | 11/2017 | Hanamitsu | A63B 71/0622 |
| 2021/0213327 | A1 | 7/2021 | Ohta et al. | |

* cited by examiner

IMPACT DETECTION DEVICE AND IMPACT DETECTION METHOD

CROSS REFERENCE TO RELATED APPLICATION

This is a continuation of International Application No. PCT/JP2021/042870 filed on Nov. 24, 2021 which claims priority from Japanese Patent Application No. 2021-019524 filed on Feb. 10, 2021. The contents of these applications are incorporated herein by reference in their entireties.

BACKGROUND ART

Technical Field

The present disclosure relates to a technique for detecting timing at which sports equipment impacts a desired object.

Patent Document 1 describes a device that analyzes a user's motion of swinging a golf club, by a sensor device attached to a shaft.

The sensor device of Patent Document 1 includes a plurality of sensors. Specifically, the sensors are an acceleration sensor, an angular velocity sensor and a distortion sensor. The device analyzes a swing of the golf club by the user, based on information obtained from the acceleration sensor and the angular velocity sensor and information obtained from distortion of the shaft.

Patent Document 1: Japanese Unexamined Patent Application Publication No. 2018-175496

BRIEF SUMMARY

However, in an existing configuration as illustrated in Patent Document 1, it is suitable to use a plurality of sensors, and a swing of a user is detected by integrally analyzing information obtained from the sensors. That is, there was a possibility that structure of the device becomes complicated and processing becomes complicated.

The present disclosure provides a device capable of more accurately detecting timing at which a golf club impacts a golf ball with a simple structure.

An impact detection device of the present disclosure includes a sensor that is attached to sports equipment including a columnar portion and a hitting portion connected to the columnar portion and is attached not at the hitting portion but at the columnar portion, and that is configured to output a sensor signal obtained by the sports equipment being swung, and a feature data extraction unit configured to detect, by using the sensor signal, from a temporal change of the sensor signal outputted by the hitting portion externally receiving pressure, timing at which the hitting portion externally receives the pressure.

In this configuration, the timing at which the sports equipment impacts a desired object can be detected using a simple structure.

According to the present disclosure, it is possible to more accurately detect timing at which a columnar portion of sports equipment impacts a desired object with a simple structure. For example, when the sports equipment is a golf club, it is possible to more accurately detect timing at which the golf club impacts a golf ball.

DETAILED DESCRIPTION

First Embodiment

Figure 1:
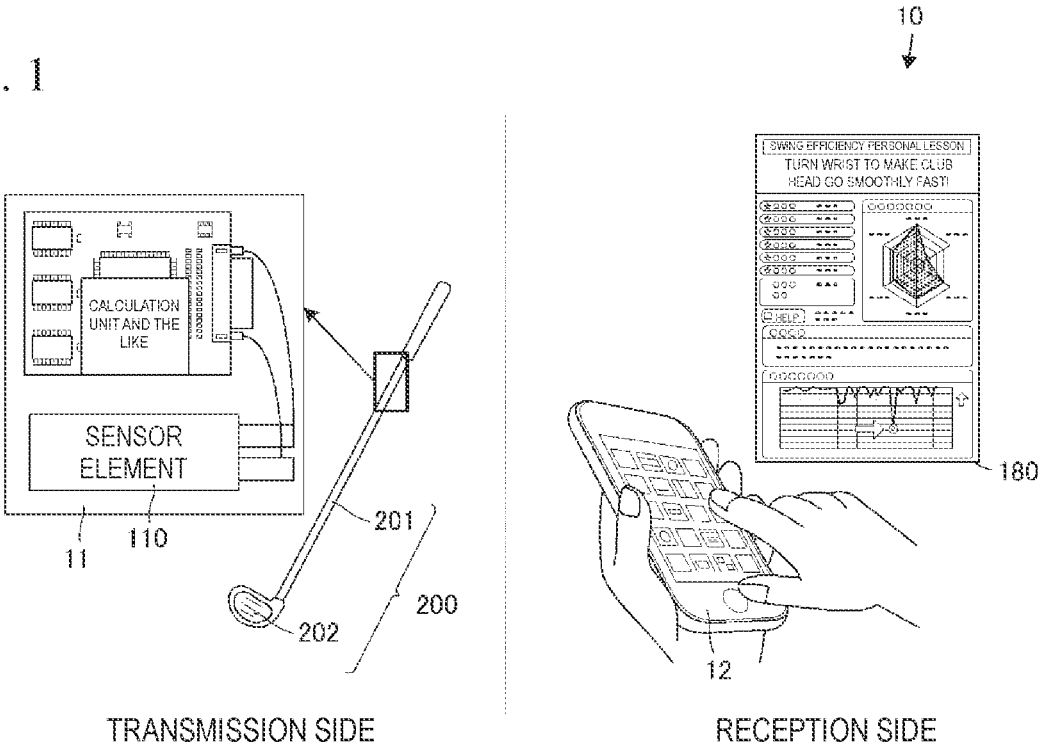
FIG. 1 is a schematic diagram of an impact detection device 10 according to a first embodiment.
Figure 2:
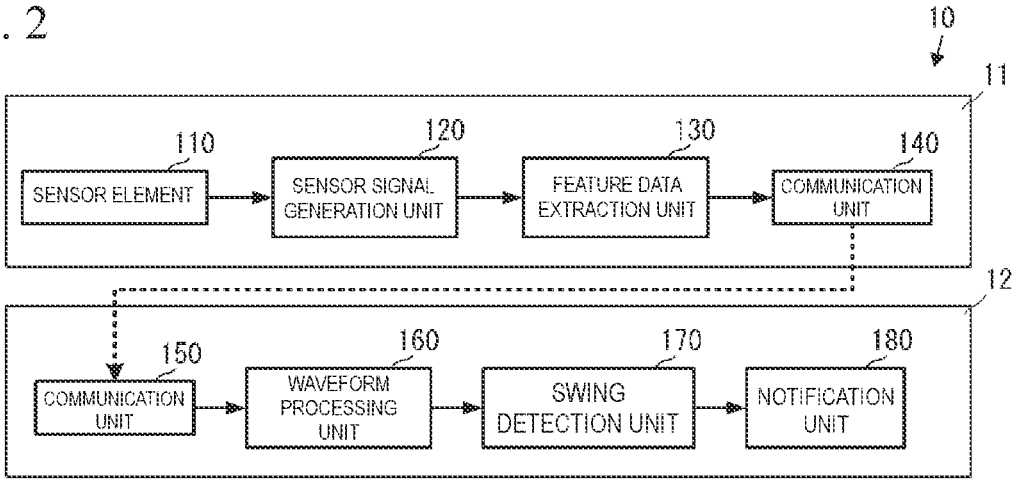
FIG. 2 is a block diagram of the impact detection device 10 according to the first embodiment.
Figure 3:
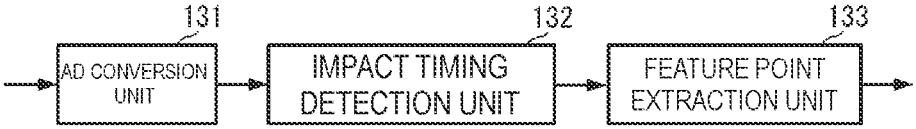
FIG. 3 is a block diagram of a feature data extraction unit 130 of the impact detection device 10 according to the first embodiment.
Figure 4:
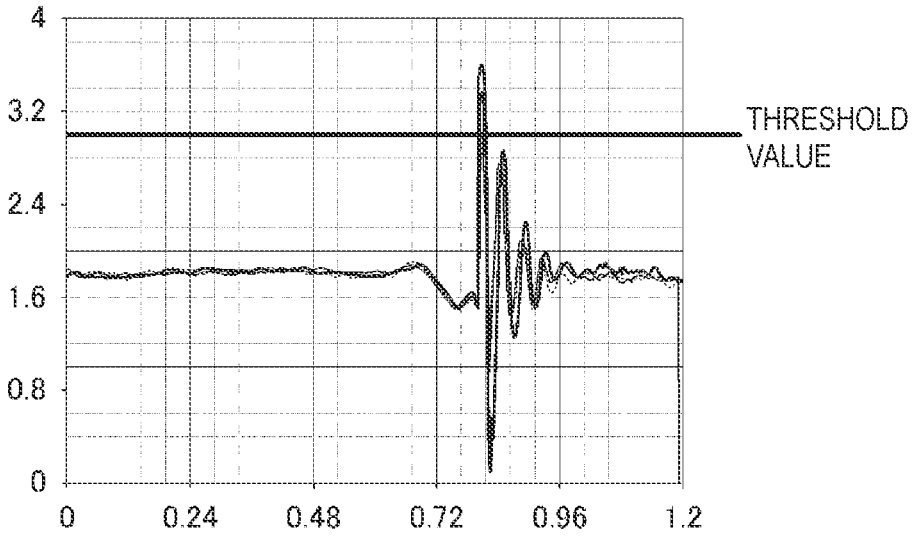
FIG. 4 is a graph depicting voltage detected by operating the impact detection device 10 according to the first embodiment.
Figure 5:
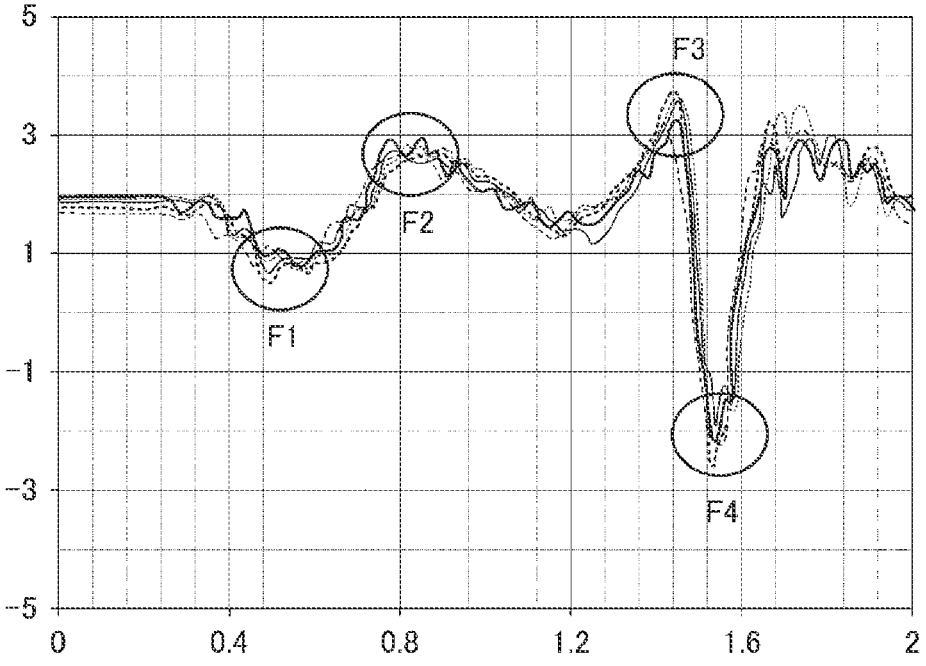
FIG. 5 is a graph depicting a result of extracting feature points of voltage detected by operating the impact detection device 10 according to the first embodiment.
Figure 6:
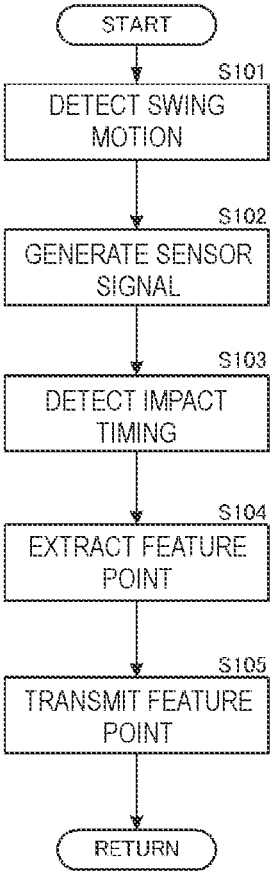
FIG. 6 is a flowchart illustrating operation of a transmission-side device 11 of the impact detection device 10 according to the first embodiment.
Figure 7:
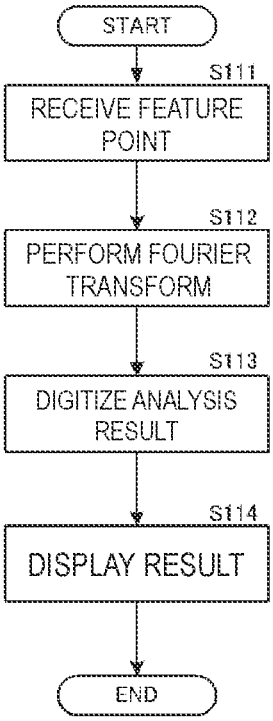
FIG. 7 is a flowchart illustrating operation of a reception-side device 12 of the impact detection device 10 according to the first embodiment.

An impact detection device according to a first embodiment of the present disclosure will be described with reference to the drawings. FIG. 1 is a schematic diagram of the impact detection device 10 according to the first embodiment. FIG. 2 is a block diagram of the impact detection device 10 according to the first embodiment. FIG. 3 is a block diagram of the feature data extraction unit 130 of the impact detection device 10 according to the first embodiment. FIG. 4 is a graph depicting voltage detected by operating the impact detection device 10 according to the first embodiment. FIG. 5 is a graph depicting a result of extracting feature points of voltage detected by operating the impact detection device 10 according to the first embodiment. FIG. 6 is a flowchart illustrating operation of the impact detection device 10 according to the first embodiment. FIG. 7 is a flowchart illustrating operation of the reception-side device 12 of the impact detection device 10 according to the first embodiment. Note that in order to make a configuration of the impact detection device easier to understand, shapes of components are partially or entirely exaggerated in each drawing.

(Outline of Impact Detection Device)

By using FIG. 1, an outline of the impact detection device 10 will be described. The impact detection device 10 includes the transmission-side device 11 and the reception-side device 12. As illustrated in FIG. 1, the transmission-side device 11 is attached to a surface of a shaft 201 of a golf club 200.

The golf club 200 is, for example, a driver. The golf club 200 is not limited to a driver, and may be any of a fairway wood, a utility, an iron, a wedge and a putter. Note that the golf club 200 corresponds to "sports equipment" of the present disclosure, the shaft 201 corresponds to a "columnar portion" of the present disclosure, and the head 202 corresponds to a "hitting portion" of the present disclosure.

A user hits a golf ball using the golf club 200 (swing motion). At this time, a sensor element 110 detects twisting due to the swing motion. The transmission-side device 11 performs analysis using a sensor signal calculated from the twisting.

The transmission-side device 11 transmits a result of the analysis to the reception-side device 12. The reception-side device 12 receives the result. The reception-side device 12 performs processing such as graphing using the result. The user checks a feature that is displayed via a GUI such as being graphed. Note that the features are strength, timing, habit, or the like of the swing by the user. Furthermore, advice on the user's swing can be displayed.

(Details of Impact Detection Device)

Next, a detailed configuration of the impact detection device 10 will be described using FIG. 1, FIG. 2, FIG. 3, FIG. 4, FIG. 5, FIG. 6, and FIG. 7. The transmission-side device 11 of the impact detection device 10 includes the sensor element 110, a sensor signal generation unit 120, the feature data extraction unit 130, and a communication unit 140. The feature data extraction unit 130 includes an AD conversion unit 131, an impact timing detection unit 132, and a feature point extraction unit 133.

The sensor signal generation unit 120, the feature data extraction unit 130, and the communication unit 140 are achieved by, for example, a plurality of electronic circuit elements such as processors or ICs mounted on a circuit board or the like.

The reception-side device 12 of the impact detection device 10 includes a communication unit 150, a waveform processing unit 160, a swing detection unit 170 and a notification unit 180 (e.g., a display). Note that it is sufficient that the reception-side device 12 is a device including a communicator, a displayer, and the like, such as a smart phone or a tablet.

A detailed configuration of the impact detection device 10 and a flow of processing will be described. The user hits a golf ball using the golf club 200 (swing motion).

When the user hits the golf ball, the golf ball collides with the head 202 of the golf club 200 (impact). This causes the golf ball to fly forward. At this time, repulsive force is transmitted to the head 202 at the moment of impact, and the repulsive force is transmitted to the shaft 201. This repulsive force causes the shaft 201 to twist. Note that the repulsive force is force generated when the head 202 externally receives pressure.

The sensor element 110 detects this twisting. More specifically, the sensor element 110 includes a film-like main body having piezoelectric properties and a detection electrode. The main body contains, for example, polylactic acid as a main component and is polarized according to bending and twisting. The detection electrode is attached to a surface of the shaft 201. The detection electrode is attached to the shaft 201 such that charge due to bending and charge due to twisting can be outputted.

When the sensor element 110 is used, a polarization direction changes according to a bending direction and a twisting direction. Additionally, magnitude of charge generated by the polarization differs according to magnitude of the bending and magnitude of the twisting. That is, when the user swings the golf club 200, a large amount of charge is generated at the time of strong shock such as an impact, and a small amount of charge is generated at the time of small shock without necessarily an impact.

The sensor signal generation unit 120 generates a voltage signal from the charge generated in the sensor element 110. The sensor signal generation unit 120 is achieved by a predetermined electronic circuit. The sensor signal generation unit 120 includes, for example, an integration circuit, and generates a sensor signal which is a voltage signal from the charge generated in the sensor element 110.

The sensor signal generation unit 120 outputs the sensor signal to the feature data extraction unit 130. The AD conversion unit 131 performs AD conversion (analog-to-digital conversion) on the sensor signal. The AD conversion unit 131 outputs the digitized sensor signal to the impact timing detection unit 132.

The impact timing detection unit 132 detects, for example, timing at which the sensor signal exceeds a threshold value, and detects the detected timing as timing of impact (hereinafter, referred to as impact timing). The impact timing detection unit 132 outputs the sensor signal and the impact timing to the feature point extraction unit 133.

Note that a value used as the threshold value by the impact timing detection unit 132 can be arbitrarily set. The threshold value may be determined based on, for example, a type of the golf club 200, or may be determined based on gender or a body type of the user.

As described above, the impact detection device 10 can detect the impact timing only by output (the sensor signal) from the sensor element 110 attached to the shaft 201.

The feature point extraction unit 133 extracts sensor signals in a period of a predetermined length starting from the impact timing and outputs, as the feature extraction unit 133, the sensor signals. More specifically, the feature point extraction unit 133 cuts out several seconds (for example, two seconds) before and after the impact timing. In the feature point extraction unit 133, as shown in the graph of FIG. 5, the feature data extraction unit 130 extracts a plurality of feature points from results of the cutout.

The feature points in FIG. 5 are, for example, F1, F2, F3, F4, and the like. As the feature point, a point at which a differential value of each value changes from positive to negative or from negative to positive within a predetermined period of time is used. The feature point extraction unit 133 converts each of the feature points F1, F2, F3, and F4 into 8-bit data (hereinafter, denoted as feature point data). The feature point data may include impact timing.

Note that the feature data extraction unit 130 may extract a feature point using a point at which an amount of change in voltage per predetermined time is equal to or greater than a threshold value (the threshold value is, for example, 2.0 V to 2.5 V, or 3 V), or a change in a value having magnitude or directionality.

The feature data extraction unit 130 transmits the feature point data to the reception-side device 12 via the communication unit 140 (e.g., a transmitter). The communication unit 140 performs wireless communication. This wireless communication is, for example, Bluetooth (registered trademark) Low Energy (BLE). By using BLE, it is possible to achieve communication in a power saving manner, in which affinity with a device such as a smart phone is improved, and convenience is enhanced.

The communication unit 150 of the reception-side device 12 receives the feature point data. The communication unit 150 outputs the feature point data to the waveform processing unit 160. The waveform processing unit 160 performs Fourier transform on the feature point data, and performs comparison using each frequency component.

This comparison method will be described in detail. First, natural frequencies after the Fourier transform are divided into two regions of a low frequency side and a high frequency side for analysis. Specifically, the waveform processing unit 160 acquires a frequency of a maximum spectrum generated in a range on each of the low frequency side and the high frequency side. For example, 3 to 10 Hz are on the low frequency side, and 10 to 100 Hz are on the high frequency side. Note that the frequencies on the low frequency side and the high frequency side can be determined as appropriate.

The waveform processing unit 160 outputs data obtained from results of analysis for strength, timing, habit, and the like of a swing by the user to the swing detection unit 170. The swing detection unit 170 quantifies the data obtained from the results of analysis as a value. At this time, the swing detection unit 170 determines whether the value is a value dependent on a type of the shaft 201 (a type of the golf club 200) or a value dependent on the user.

Furthermore, it is good that the swing detection unit 170 performs the analysis using artificial intelligence (AI). In this case, AI may use learning data (teacher data) for classification into data obtained with experiment data and data close to labeled data that is a target, or a K-means method based on a feature of a waveform may be used to perform classification into arbitrary N pieces. By using AI in this manner, it is possible to perform comparison of features of the swing by the user (the strength, timing, habit, and the like of the swing by the user).

The swing detection unit 170 outputs the quantified result to the notification unit 180. The notification unit 180 displays the result via a GUI using a graph or the like as in the notification unit 180 illustrated in FIG. 1. The user checks the features obtained from his/her own swing motion. In the notification unit 180, the strength, timing, habit, and the like of the swing by the user are displayed in the graph, and further, advice on the user's swing can be displayed. At this time, since the features of the swing are displayed on the notification unit 180 using the graph, it is easy for the user to visually understand.

A flow of processing of the impact detection device 10 will be described using FIG. 6 and FIG. 7. First, FIG. 6 is used to describe a flow of processing of the transmission-side device 11.

The sensor element 110 detects twisting caused by a swing motion (S101).

The sensor signal generation unit 120 generates a voltage signal from charge generated in the sensor element 110. The sensor signal generation unit 120 outputs the voltage signal to the feature data extraction unit 130 (S102).

The feature data extraction unit 130 calculates an absolute value of a voltage after AD conversion, and detects timing at which the head 202 of the golf club 200 impacts a golf ball from timing at which the absolute value of the voltage exceeds a threshold value (S103).

The feature data extraction unit 130 extracts a feature point in several seconds before and after the impact timing (S104).

The feature data extraction unit 130 transmits feature point data to the reception-side device 12 via the communication unit 140 (S105).

Next, FIG. 7 is used to describe a flow of processing of the reception-side device 12.

The communication unit 150 of the reception-side device 12 receives the feature point data (S111).

The communication unit 150 outputs the feature point data to the waveform processing unit 160. The waveform processing unit 160 performs Fourier transform on the feature point data, and performs comparison using each frequency component (S112).

The waveform processing unit 160 outputs a result of the analysis to the swing detection unit 170. The swing detection unit 170 quantifies data obtained from the result of analysis (S113).

The swing detection unit 170 outputs the quantified result to the notification unit 180. The notification unit 180 displays the result via the GUI (S114).

With such a configuration, even with a simple structure attached only to a shaft, it is possible to accurately detect features, including impact timing, at the time of the user's own swing. In addition, since the impact detection device attached to the shaft is very light in weight, feeling of use by the user is not impaired.

In the above-described configuration, an attachment position of the transmission-side device 11 of the impact detection device 10 is not particularly predetermined. Accordingly, the user does not need to be aware of the attachment position, and convenience is improved.

Note that in the above-described configuration, the attachment position of the transmission-side device 11 is arbitrary. However, when the user swings a putter (the golf club 200), the attachment position can be positioned close to the head 202. In this case, the sensor element 110 can accurately detect twisting of the shaft 201 even when repulsive force from a golf ball is small. In other words, when a different type of golf club 200 is used but an attachment position of the transmission-side device 11 is the same, the type of golf club 200 can be determined.

In addition, the configuration has been described in which the waveform processing unit 160 and the swing detection unit 170 are included in the reception-side device 12. However, a configuration may be adopted in which the transmission-side device 11 includes the waveform processing unit 160 and the swing detection unit 170. In this case, the reception-side device 12 may only display the results. With this configuration, it is possible to provide a configuration that is not affected by a type and specifications of the reception-side device 12.

In addition, in the above-described configuration, the sensor element 110 detects twisting of the shaft 201. However, the sensor element 110 may also detect bending of the shaft 201.

Further, the impact detection device 10 in the first embodiment may be configured to include a storage unit in which history data of the user can be saved. In this case, a history of data to be outputted to the notification unit 180 can be displayed. With this configuration, it is possible to compare swings up to a previous swing, including the time of impact, with a swing of this time, or the like.

Further, a configuration may be adopted in which features of a swing by a golf player serving as a model are stored in a storage unit in advance so that his/her own swing can be compared with the swing by the player serving as the model.

Second Embodiment

Figure 8:
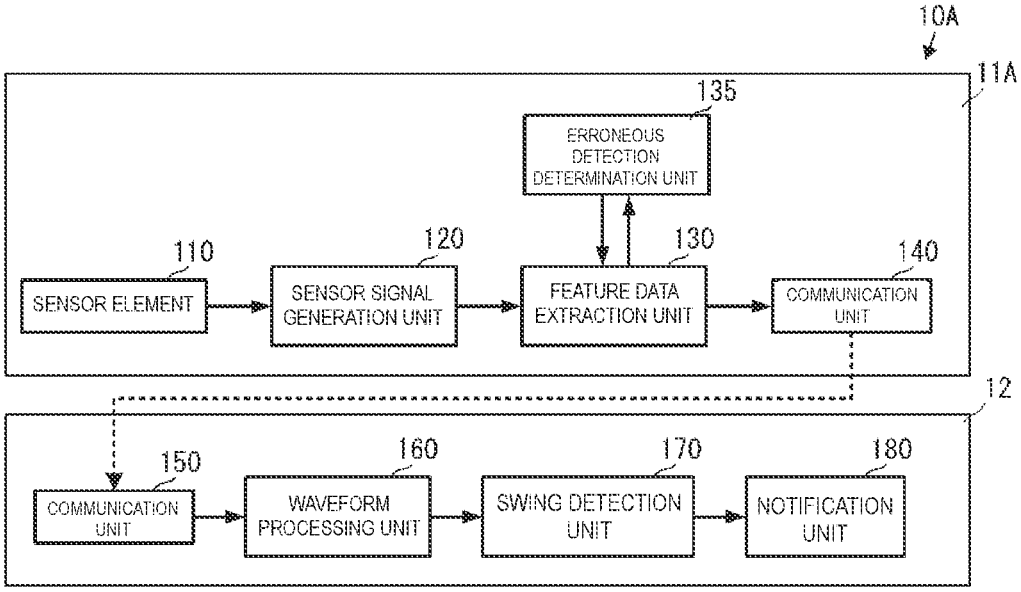
FIG. 8 is a block diagram of an impact detection device 10A according to a second embodiment.
Figure 9:
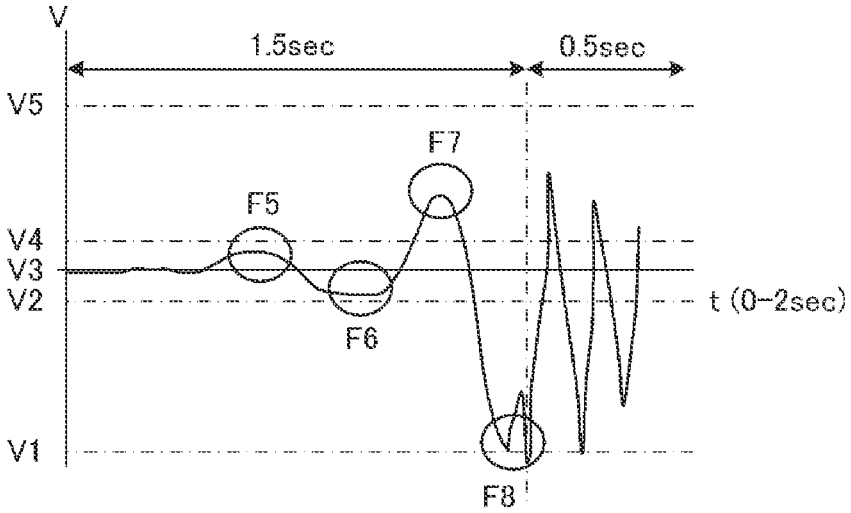
FIG. 9 is a graph depicting voltage detected by operating the impact detection device 10A according to the second embodiment.

An impact detection device according to a second embodiment of the present disclosure will be described with reference to the drawings. FIG. 8 is a block diagram of the impact detection device 10A according to the second embodiment. FIG. 9 is a graph depicting voltage detected by operating the impact detection device 10A according to the second embodiment.

As illustrated in FIG. 8 and FIG. 9, the impact detection device 10A according to the second embodiment is different from the impact detection device 10 according to the first embodiment in a configuration of a transmission-side device 11A. Other configurations of the impact detection device 10A are similar to those of the impact detection device 10, and description of similar portions will be omitted.

As illustrated in FIG. 8, the impact detection device 10A includes the transmission-side device 11A and the reception-side device 12. The transmission-side device 11A includes the sensor element 110, the sensor signal generation unit 120, the feature data extraction unit 130, an erroneous detection determination unit 135 and the communication unit 140.

The erroneous detection determination unit 135 determines whether or not an abnormality occurs in a feature point. A more specific flow of processing will be described using FIG. 8 and FIG. 9. As shown in FIG. 9, the feature data extraction unit 130 extracts a plurality of feature points F5, F6, F7, and F8.

The erroneous detection determination unit 135 determines magnitude of each feature point using voltage serving as reference (in this case, a reference voltage V3). For each of the feature points F5 and F6, the erroneous detection determination unit 135 determines that amplitude of voltage with respect to the reference voltage V3 is too small (between V2 and V4). In this case, the erroneous detection determination unit 135 determines that a contact failure has occurred in the impact detection device 10A. Additionally, for the feature point F8, it is determined that amplitude of voltage with respect to the reference voltage V3 is too large (V1). In this case, the erroneous detection determination unit 135 determines that the voltage is saturated. On the other hand, the erroneous detection determination unit 135 determines that the feature point F7 is normal.

When determining that at least one abnormal value occurs at the plurality of feature points, the erroneous detection determination unit 135 outputs a result of the determination to the feature data extraction unit 130.

Based on the determination result, the feature data extraction unit 130 determines whether or not to continue to perform subsequent processing. At this time, when at least one abnormal value occurs, the feature data extraction unit 130 can interrupt the processing and can display a warning message or the like.

Even with such a configuration, it is possible to accurately detect features of the user's own swing and features at the time of impact. Further, when an abnormality occurs in the impact detection device 10A, determination using abnormal data is not performed, and thus it is possible to detect features of a swing and features at the time of impact with higher accuracy.

Third Embodiment

Figure 10:
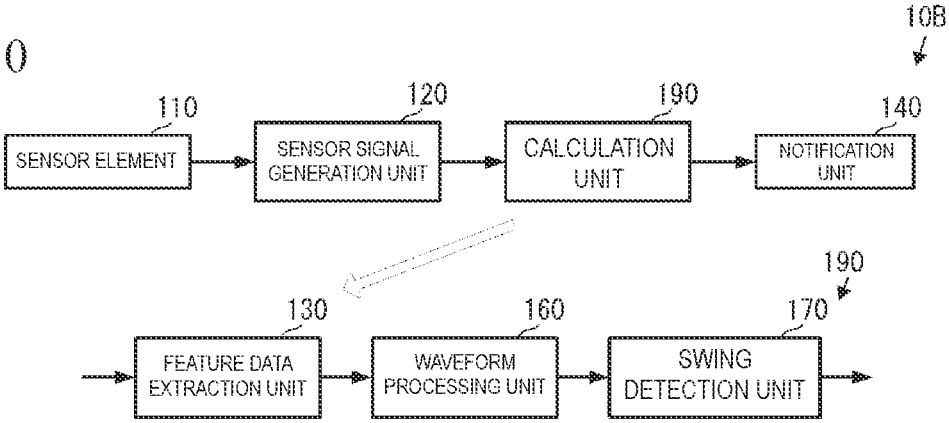
FIG. 10 is a block diagram of an impact detection device 10B according to a third embodiment.

An impact detection device according to a third embodiment of the present disclosure will be described with reference to the drawings. FIG. 10 is a block diagram of the impact detection device 10B according to the third embodiment.

As illustrated in FIG. 10, the impact detection device 10B according to the third embodiment is different from the impact detection device 10 according to the first embodiment in that the configurations of the transmission-side device 11 and the reception-side device 12 in the first embodiment are included. Other configurations of the impact detection device 10B are similar to those of the impact detection device 10, and descriptions of similar portions will be omitted.

As illustrated in FIG. 10, the impact detection device 10B includes the sensor element 110, the sensor signal generation unit 120, a calculation unit 190, and the notification unit 180. The calculation unit 190 includes the feature data extraction unit 130, the waveform processing unit 160, and the swing detection unit 170. The notification unit 180 has a simple notification function similar to that of an LED. The notification unit 180 gives notice of a result of a swing by the user, using colors, display, or the like.

The calculation unit 190 (swing detection unit 170) quantifies data obtained from an analysis result. The swing detection unit 170 calculates, from the quantified result, a simple result such as OK or NG for determining whether or not normal impact on a golf ball occurs, for example. The swing detection unit 170 outputs the simple result to the notification unit 180. The notification unit 180 changes the colors of the LED, based on the simple result. Thus, the user can visually determine whether or not the result of the swing is normal.

Even with such a configuration, it is possible to accurately detect features of the user's own swing and features at the time of impact. Furthermore, in the impact detection device 10B, a problem that a result is not displayed due to a communication failure or the like can be solved when a configuration not including a communication unit is used.

Note that in the above description, the aspect in which the golf club is used as the sports equipment has been illustrated. However, the configuration of the present disclosure can be applied to any sports equipment (for example, a bat for baseball or the like, or a racket for tennis, badminton, or the like), and the same effects can be obtained, as long as the sports equipment has a columnar portion and displacement occurs in the columnar portion when impacted by a desired object such as a ball, a shuttle, or the like.

REFERENCE SIGNS LIST

F1, F2, F3, F4, F5, F6, F7, F8 FEATURE POINT
10, 10A, 10B IMPACT DETECTION DEVICE
11, 11A TRANSMISSION-SIDE DEVICE
12 RECEPTION-SIDE DEVICE
110 SENSOR ELEMENT
120 SENSOR SIGNAL GENERATION UNIT
130 FEATURE DATA EXTRACTION UNIT
131 AD CONVERSION UNIT
132 IMPACT TIMING DETECTION UNIT
133 FEATURE POINT EXTRACTION UNIT
135 ERRONEOUS DETECTION DETERMINATION UNIT
140, 150 COMMUNICATION UNIT
160 WAVEFORM PROCESSING UNIT
170 SWING DETECTION UNIT
180 NOTIFICATION UNIT
190 CALCULATION UNIT
200 GOLF CLUB
201 SHAFT
202 HEAD

The invention claimed is:

1. An impact detection device for sports equipment including a columnar portion and a hitting portion connected to the columnar portion, comprising:

a sensor that is attached to the columnar portion and is not attached to the hitting portion, and that is configured to output a sensor signal obtained by the sports equipment being swung; and a processor configured to detect a timing at which the hitting portion is externally pressured, by using a temporal change of a spectral intensity of a specific frequency of the sensor signal.

2. The impact detection device according to claim 1, wherein the sensor is configured to detect a twist component of the columnar portion and to output the sensor signal including the twist component.

3. The impact detection device according to claim 2, wherein the spectral intensity of the specific frequency is of the twist component of the sensor signal.

4. The impact detection device according to claim 3, wherein the processor is configured to:

store a threshold value for the spectral intensity of the specific frequency, and extract the timing based on a time point at which the spectral intensity exceeds the threshold value.

5. The impact detection device according to claim 4, further comprising a transmitter configured to transmit the timing.

6. The impact detection device according to claim 1, further comprising a display configured to display a result obtained by analyzing the timing.

7. The impact detection device according to claim 1, wherein the sensor is configured to detect a bend component of the columnar portion and to output the sensor signal including the bend component.

8. An impact detection method for sports equipment including a columnar portion and a hitting portion connected to the columnar portion, comprising the steps of:

outputting, by a sensor attached to the columnar portion and not attached to the hitting portion, a sensor signal obtained by the sports equipment being swung; and detecting a timing at which the hitting portion is externally pressured, by using a temporal change of a spectral intensity of a specific frequency of the sensor signal.

9. The impact detection method according to claim 8, further comprising:

detecting, by the sensor, a twist component of the columnar portion, wherein the outputted sensor signal includes the twist component.

10. The impact detection method according to claim 9, wherein the spectral intensity of the specific frequency is of the twist component of the sensor signal.

11. The impact detection method according to claim 10, further comprising:

storing a threshold value for the spectral intensity of the specific frequency, wherein the timing is extracted based on a time point at which the spectral intensity exceeds the threshold value.

12. The impact detection method according to claim 11, further comprising:

transmitting the timing.

13. The impact detection method according to claim 8, further comprising:

displaying a result obtained by analyzing the timing.

14. The impact detection method according to claim 8, further comprising:

detecting, by the sensor, a bend component of the columnar portion, wherein the outputted sensor signal includes the bend component.

* * * * *